US006805341B2

(12) United States Patent
Furukawa

(10) Patent No.: US 6,805,341 B2
(45) Date of Patent: Oct. 19, 2004

(54) SHEET FEEDING DEVICE AND IMAGE FORMING APPARATUS

(75) Inventor: Kimiaki Furukawa, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 61 days.

(21) Appl. No.: 10/301,667

(22) Filed: Nov. 22, 2002

(65) Prior Publication Data

US 2004/0100014 A1 May 27, 2004

(51) Int. Cl.[7] ..... B65H 5/00
(52) U.S. Cl. ..... 271/10.09; 271/114
(58) Field of Search ..... 271/109, 113, 271/114, 4.08, 10.09

(56) References Cited

U.S. PATENT DOCUMENTS 3,770,266 A * 11/1973 Wehr et al. ..... 271/97
5,435,539 A * 7/1995 Namiki ..... 271/114
5,451,042 A * 9/1995 Cuir et al. ..... 271/112
5,601,281 A * 2/1997 Kubodera et al. ..... 271/10.04
5,628,503 A * 5/1997 Ishikawa ..... 271/4.1
6,565,078 B1 * 5/2003 Foglino et al. ..... 271/124

FOREIGN PATENT DOCUMENTS

JP 11-171354 A 6/1999
JP 2000-191149 A 7/2000
JP 2001-233497 A 8/2001

* cited by examiner

*Primary Examiner*—David H. Bollinger
(74) *Attorney, Agent, or Firm*—Foley & Lardner LLP

(57) ABSTRACT

A paper feeder of the present invention includes a paper tray for supporting paper and pickup rollers in total width more than 40% of the maximum paper width supportable by a paper tray for taking out a paper at the top position in a specified direction. This paper feeder is used for paper feeding of image forming apparatuses.

15 Claims, 6 Drawing Sheets

SHEET FEEDING DEVICE AND IMAGE FORMING APPARATUS

BACKGROUND OF THE INVENTION

1. Field of the Invention

The present invention relates to a paper feeder that is for picking up paper used in such apparatuses as electrophotographic apparatus, printers, etc. one sheet at a time and feeding pickup paper in a prescribed direction, and an image forming apparatus using this paper feeder.

2. Description of the Related Art

A paper feeder adopting a frictional paper feeding system for taking out paper placed in a paper supply tray in a paper supply cassette or a manual paper supply tray using a friction paper supply member, for example, pickup rollers, separating taken out paper one by one using a separation pad or a separation roller and sending out the paper in the image forming direction is now put in practical use in image forming apparatus widely.

On the other hand, color image formation and high quality image formation of image forming apparatus are in widespread use in recent years and stabilized supply of a large amount of thicker paper and coating paper, etc. is demanded. However, weight (mass per unit area) of such special paper as thicker paper, coating paper is larger than ordinary paper and furthermore, in the case of coating paper, sheets have good smoothness and are closely adhered to each other. Therefore, it becomes difficult to separate special sheets of paper having a highly close adhering force and it was difficult to supply paper stably for conventional pickup rollers that were for frictionally supplying ordinary paper.

Therefore, it was so far a general practice to feed special paper having a high adhering force between sheets of paper by setting paper in a manual paper supply tray one by one using a manual paper feeder in a conventional image forming apparatus.

However, when paper is set in a manual tray one by one, productivity of image formation is low and cannot meet a demand for mass production of a large amount of images at a high speed.

So far, as disclosed in Japanese Patent Application No. 11-171354, an apparatus has been developed to get a stable paper supply by varying pressure force of pickup rollers according to characteristic of using paper.

However, in a conventional paper feeder that varies pressure force of pickup rollers, in case of paper has high adhesion force between paper, when the pressure force of the pickup rollers is increased, this pressure force acts on not only a paper placed on the top but also second and subsequent paper. As a result, the paper adhesion force becomes higher, good separation cannot be obtained and the stable paper feeding is impeded.

When paper with extremely high paper adhesion and thin resin coated on both surfaces for use by color copiers were supplied, separation resisting force caused by adhesion force generated on the overall surface of paper became higher than friction paper supply force by pickup rollers, separation of paper was made difficult and the stable paper feeding was enabled.

Accordingly, when paper with extremely high separation resisting force are supplied by the friction paper supply system, it is demanded to get the stable supply of a large amount of paper at a high speed regardless of kind of paper and is desired to get a paper feeder and an image forming apparatus having high productivity.

SUMMARY OF THE INVENTION

An object of the present invention is to feed a large amount of paper at a high speed regardless of kind of paper by increasing a paper feeding capacity of a frictional paper feeding system by making it easy to separate paper having large adhesion force against separation resisting force.

According to the embodiments of the present invention, there is provided a paper feeder comprising: a paper tray; and friction paper supplying members with a total width more than 40% of the maximum paper width supportable by the paper trays for taking out a paper at the top position supported by the paper tray in the prescribed take-out direction.

Further, according to the embodiments of the present invention, there is provided a paper feeder comprising a paper tray to supporting paper and friction paper supplying members that are in parallel with the width direction of the paper supported by the paper tray, divided and arranged on plural shafts for taking out the paper at the top position supported by the paper tray.

In addition, according to the embodiments of the present invention, there is provided an image forming apparatus comprising: a paper supply tray provided in the main body of the apparatus for supporting paper; pickup rollers with a total width more than 40% of the maximum paper width supportable by the paper supply tray; and image forming mechanisms provided in the main body of the apparatus for forming images on the paper taken out by the pickup rollers.

Furthermore, according to the embodiments of the present invention, there is provided an image forming apparatus comprising: a paper supply tray provided in the main body of the apparatus for supporting paper; pickup rollers in parallel with the width direction of the paper supported by the paper supply tray and divided and arranged on plural shafts for taking out a paper at the top position supported by the paper supply tray; and image forming mechanisms provided in the main body of the apparatus for forming images on the paper taken out by the pickup rollers.

DETAILED DESCRIPTION OF THE EMBODIMENTS

Figure 1:
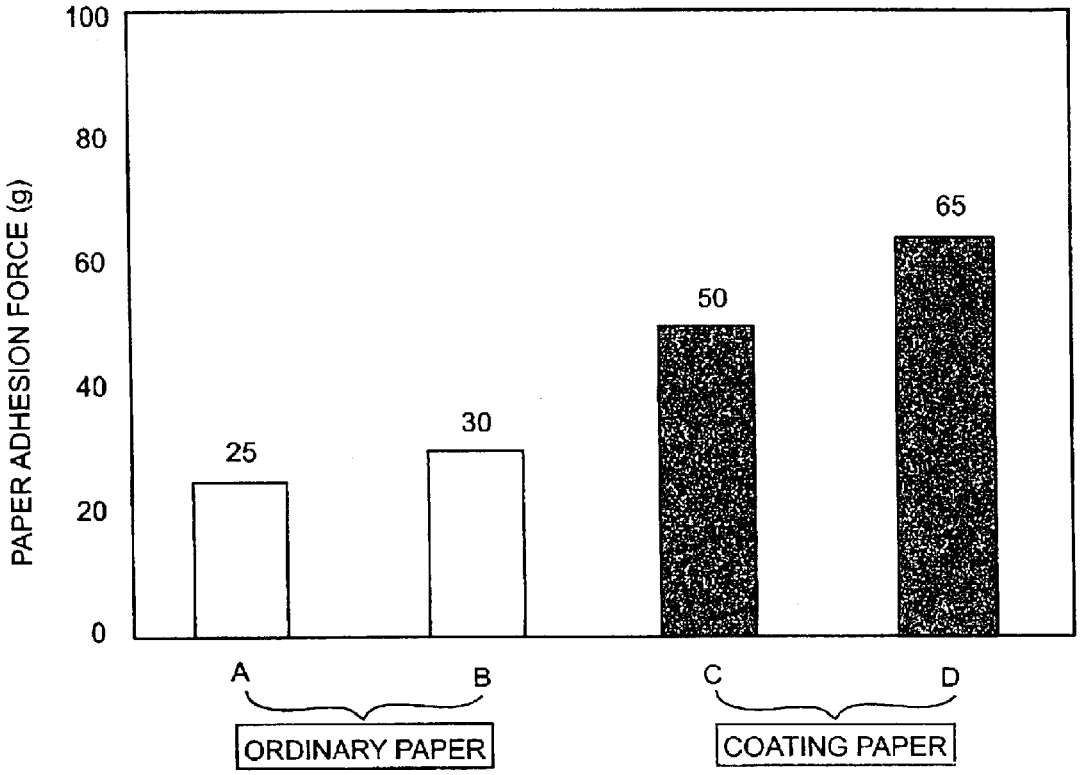
FIG. 1 shows "adhesion of paper that is used in an image forming apparatus (graph)"

First, adhesion forces of A3 ordinary paper weighing 105 g/m$^2$ and weighing 162.4 g/m$^2$ and A3 paper weighing 105 g/m$^2$ and 162.4 g/m$^2$ thin resin coated on both sides for color copying machine use were measured with the result shown in FIG. 1. In the measuring, 500 sheets of paper to be measured were piled up with one pack of paper (500 sheets) put thereon for 10 sec. as a weight. Then, after closely fitting them, the paper pack used as a weight was removed, the top paper was pulled horizontally and a force required for the pulling was measured with a spring scale.

As a result, in the case of the A3 size weighing 105 g/m$^2$ ordinary paper, an adhesion force was 25 g while that of the coated paper was 50 g. In the case of A3 size paper weighing 162.4 g/m$^2$, an adhesion force of the ordinary paper was 30 g while that of the coated paper was 65 g, and it was found that an adhesion force of coating paper having good smoothness is about twice of ordinary paper. In the case of coated paper, this increased paper adhesion force causes resistance in conveying paper and poor paper feeding.

On the other hand, when feeding ordinary paper using, for example, a pickup roller, paper can be supplied stably if the overall width of the roller is 15–20% of the maximum width of paper. Based on this test results, using a pickup roller in the overall width formed to 40% of the maximum paper width, a feeding test of coating paper in double adhesion force of ordinary paper was conducted. As a result, it was found that the paper feeding force of a pickup roller is increased and a stable paper feeding performance can be provided.

Based on the above-mentioned test results, preferred embodiments of the present invention will be described below in detail.

Figure 2:
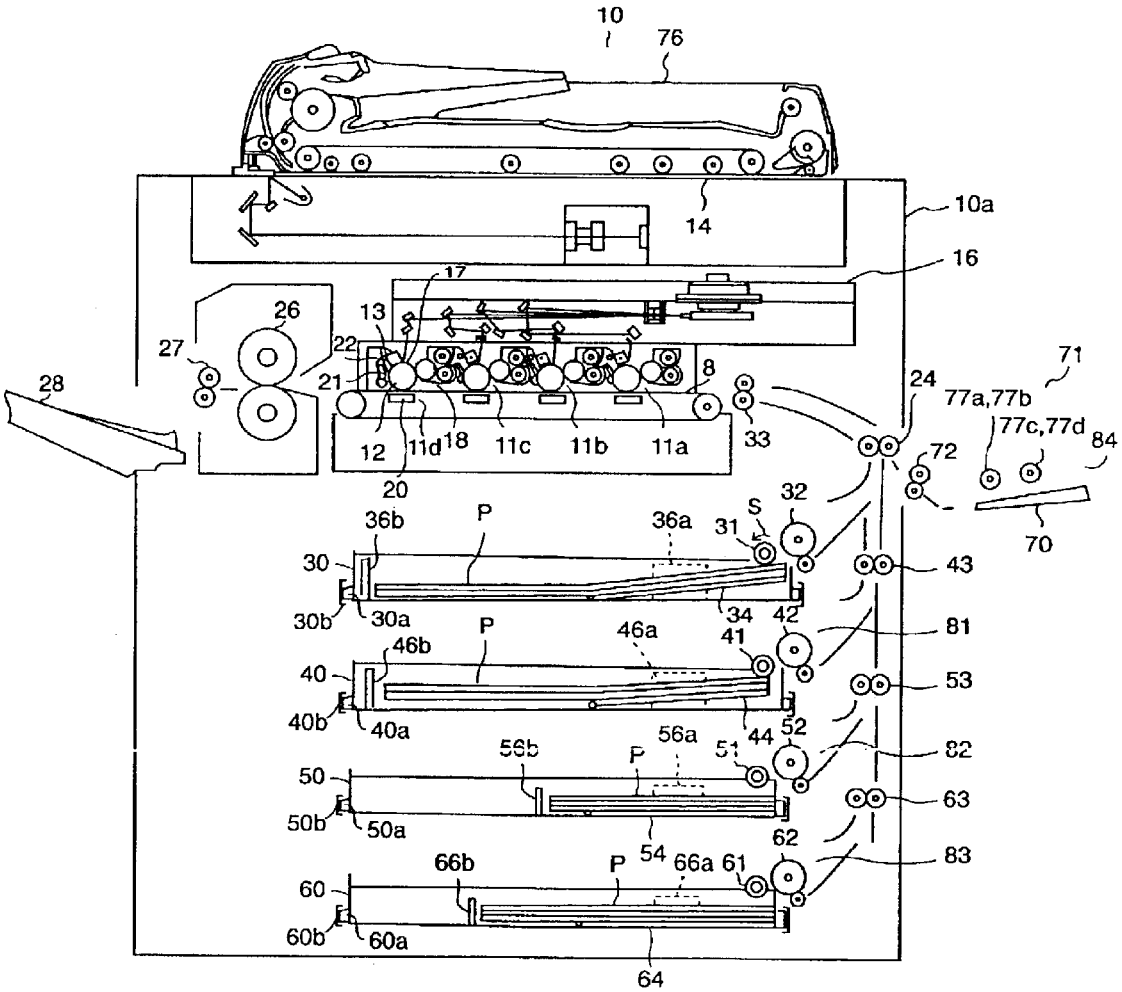
FIG. 2 is a schematic diagram showing an image forming apparatus in a first embodiment of the present invention.

FIG. 2 is a schematic diagram showing an image forming apparatus in the first embodiment of the present invention. Four sets of image forming mechanisms 11*a*–11*d* are arranged in parallel along a conveyor belt 8, and a main body 10 of four tandem color copying machines to obtain a color image and an automatic document feeder 76 are shown.

Each of the image forming mechanisms 11*a*–11*d* is provided with a main charger 13, an exposing device 17 of an exposure unit 16 that exposes a document on a document table 14, a developing unit 18, a transfer/separation charger 20, a cleaner 21 and a charge elimination lamp 22 arranged around a photosensitive drum 12 in its rotating direction. Further, the developing unit 18 of the image forming mechanisms 11*a*–11*d* develops an image using two-component developers comprising yellow (Y), magenta (M), cyan (C) and black (BK) toners and carriers.

Under the main body 10 of the apparatus, first through fourth paper supply cassettes 30–60 for storing paper P that are supplied to the image forming mechanisms 11*a*–11*d* are installed detachably and a manual paper supply tray 79 is provided at the right side of the main body 10 of the apparatus. Guide rails 30*a*–60*a* formed on the side of the paper supply cassettes 30–60 are guided by the guides 30*b*–60*b* provided on the cabinet 10*a* of the main body 10 so that they can be pulled out from the main body 10*a* or housed therein.

At the upper stream side from the conveyor belt 8, first through fourth supply mechanisms 80–83 for picking up paper P in the first through third paper supply cassettes 30–50, a manual paper supply mechanism 84 for picking up paper P from a manual paper supply tray 70, first through third transferring rollers 33–53, and an aligning roller 24 are provided. At the down stream side of the conveyor belt 8, a fixing roller pair 26, a paper discharging roller pair 27 and a paper receiving tray 28 are arranged. Further, a numeral 76 denotes an automatic document feeder to supply documents to the document table 14.

Next, a paper feeder to feed paper P from the first-fourth paper supply cassettes 30–60 or the paper supply tray 70 to the image forming mechanisms 11*a*–11*d* will be described in detail. Of the first-fourth paper supply cassettes 30–60, the first paper supply cassette 30 provided at the first stage is capable of supplying mainly maximum 297 mm wide× maximum 420 mm long A3 size paper of thin resin coated at both sides for color copying machine. The second-fourth paper supply cassettes 40–60 at the second through fourth stages supply mainly ordinary paper in various sizes and also are capable of supplying A4 and smaller size coated paper.

The first-fourth paper supply cassettes 30–60 are provided with first through fourth paper supply trays 34–64 at the respective bottoms to supporting the leading edge of paper P in the pick-up direction. The paper supply trays 34–64 push up paper P and rotate them by an elevating means (not illustrated). At the bottoms of the paper supply cassettes 30–60, there are width control plates 36*a*–66*a* that slide to control both sides of paper P corresponding to paper width and trailing edge control plates 36*b*–66*b* that slide to control trailing edge of paper P corresponding to paper length.

Next, the first through fourth paper supply mechanisms 80–83 and the manual paper supply mechanism 84 of the paper supply unit are provided with first through fourth pickup rollers 31–61 that are friction paper supply members and a manual pickup roller 71 for picking up paper P from the paper supply cassettes 30–60 and the manual tray 70, respectively and are further provided with first through fourth separation roller pairs 32–62 and a manual separation roller pair 72 for separating the paper P taken out by the pick-rollers 31–61 and 71. The first through fourth paper supply mechanisms 80–84 and the manual paper supply mechanism 86 are turned ON/OFF with a main motor by a paper supply clutch 209 so that they operate only when supplying paper. Further, the rotating speeds of the pickup rollers 31–61, 71 are controlled to specified speeds by a controller 200 that controls the main body of a color copying machine.

Figure 3:
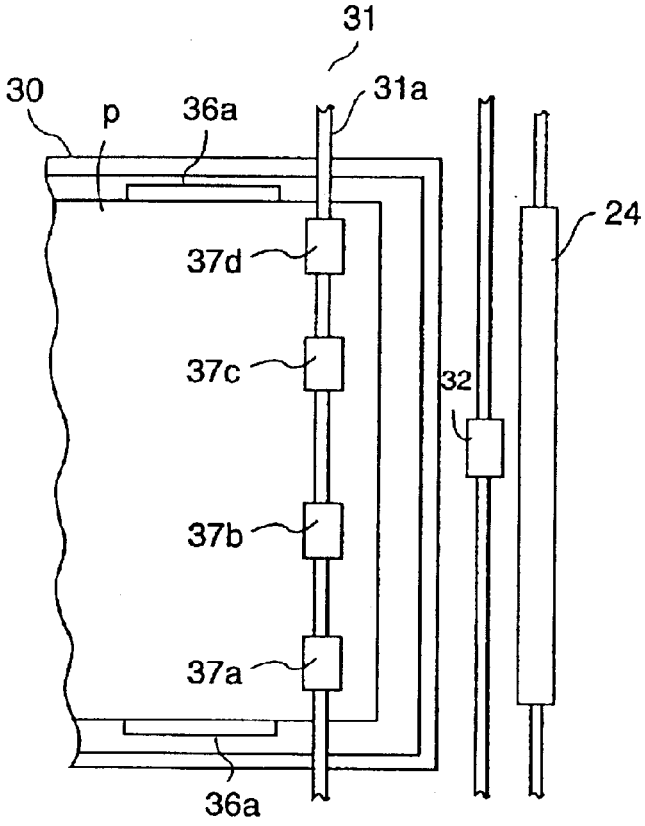
FIG. 3 is a schematic top view showing a part of a paper cassette and a fist pickup roller pair in the first embodiment of the present invention.
Figure 4:
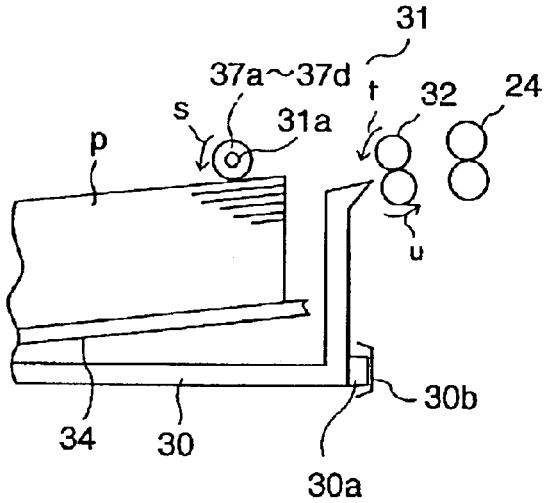
FIG. 4 is a schematic side view showing a part of the first paper cassette and the first pickup roller pair in the first embodiment of the present invention.

FIG. 3 and FIG. 4 shows the paper supply cassettes and the pickup rollers in an image forming apparatus that is the first embodiment. The first pickup roller comprises first through fourth rollers 37*a*–37*d* in 30 mm wide attached to a shaft 31*a*. A total roller widths of the first through fourth rollers 37*a*–37*d* is 120 mm, which is about 40% of the maximum paper width 297 mm supported by the first paper supply tray 34.

On the other hand, the second through fourth pickup rollers 41–61, have 30 mm wide roller pairs 47*a*–67*a* attached to shafts 41*a*–61*a*, respectively and a total roller width is 60 mm, which is about 20% of the maximum paper width 297 mm supported by the second through fourth paper supply trays 44–64.

Figure 5:
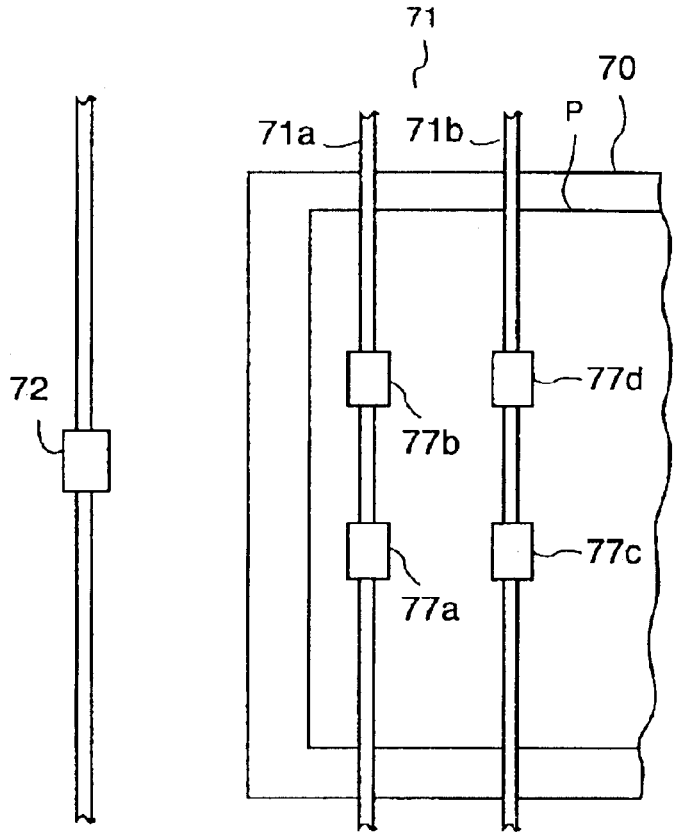
FIG. 5 is a schematic top view showing a part of a manual paper feeding tray and a manual pickup roller pair in the first embodiment of the present invention.
Figure 6:
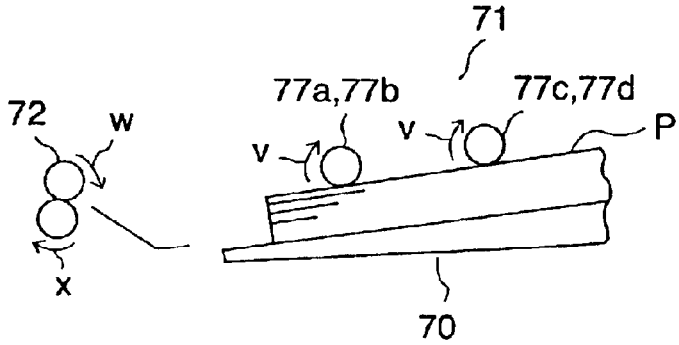
FIG. 6 is a schematic side view showing a part of a manual feeding tray and a manual pickup roller pair in the first embodiment of the present invention.

Further, FIG. 5 and FIG. 6 show parts of the manual paper supply tray and manual pickup roller. The manual paper supply pickup roller 71 comprises 30 mm wide first and second manual rollers 77*a*, 77*b* attached to a first shaft 71*a* and 30 mm width third and fourth manual rollers 77*c* and 77*d* attached to a second shaft 71*b*.

A total roller width of the first and second manual rollers 77*a*, 77*b* is 60 mm, that is about 20% of the maximum paper width 297 mm supported by the manual tray 70, and a total roller width of the first through fourth manual rollers 77*a*–77*d* is 120 mm, that is about 40% of the maximum paper width 297 mm supported by the manual tray 70.

Further, the manual pickup roller 71 is controlled by a controller 200 so as to drive the first shaft 71*a* only when paper P on the manual tray 70 is ordinary paper or coating paper smaller than A4 size and drive both the first and second shafts 71*a*, 71*b* in the case of coating paper larger than A4 size.

Figure 7:
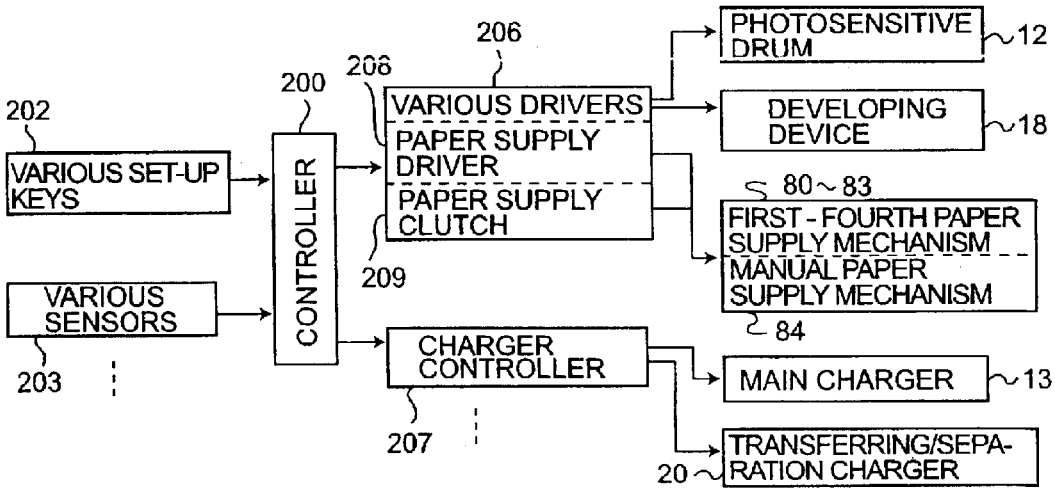
FIG. 7 is a schematic block diagram showing the control system of the main body of the apparatus in the first embodiment of the present invention.

FIG. 7 is a block diagram showing a control system of the main body 10 of the color image forming apparatus. At the input side of the controller 200, a various set-up key 202 for setting kind of paper and image conditions and various switches and sensors 203 including paper sensing switches (not illustrated) in the paper conveying path, toner density sensors (not illustrated) on the operation panel (not illustrated) are connected.

At the output side of the controller 200, there are various drivers 206 for controlling various driving devices including the photosensitive drum 12, the developing device, etc., a charger controller 207 for controlling applied voltage of the main charger 13, the transferring/separation chargers 20, etc. by controlling a high voltage power source, etc. connected. The various drivers 206 include a paper supply driver 208 for controlling the first through fourth paper supply mechanisms 80–83 or the manual paper supply mechanism 84 and further, a paper supply clutch 209 for turning ON/OFF the first through fourth paper supply mechanisms 80–83 or the manual paper supply mechanism 84 with the main motor (not illustrated).

Next, actions of the paper feeder will be described. The first paper supply cassette 30 of the main body houses A3 size coating paper for color copying machine. Ordinary paper is housed in the second through fourth paper supply cassettes.

At the time when starting the A3 size color image forming, set a document in the automatic document feeder 76, input image forming conditions through the operation panel (not illustrated) and start the copying by pushing a copy button (not illustrated). The first paper supply mechanism 80 is turned ON by the paper supply clutch 209, and the driving force of the main motor is transmitted to the shaft 31*a* by the control of the paper supply driver 208 and the shaft 31*a* is rotated at a specified speed.

Further, the automatic document feeder 76 and the image forming mechanisms 11*a*–11*d* are driven, the beam scanning by the exposure device is carried out and the photosensitive drums 12 are rotated and the image forming processes are executed in order. The photosensitive drums 12 are charged by the main charger 13, yellow, magenta, cyan and black image beams are applied and electrostatic latent images are formed. Further, after toner images in respective colors are formed on the photosensitive drums 12 by the developing device 18, the formed toner images are transferred on a paper P being conveyed on the conveyor belt 8.

On the other hand, while toner images in respective colors are being formed on the photosensitive drum 12, a paper P positioned at the top in the first paper supply cassette 30 is taken out easily against the paper adhesion force by the frictional paper supply force of the first through the fourth rollers 37*a*–37*d* in the total width of about 40% of A3 size paper width rotating in the arrow direction. Then, the top paper P is easily separated from the second and succeeding paper P by the frictional separating force of the separation roller 32 rotating in the arrow directions t and u, and is sent out in the direction of aligning roller 24.

Thereafter, the paper P is once stopped at the position of the aligning roller 24 and after its leading edge is aligned, the paper P is sent to the transferring position of the conveyor belt synchronizing with toner images on the photosensitive drums 12 and yellow, magenta, cyan and black toner images are multi-transferred on the paper sequentially at the position of the photosensitive drum 12. Thereafter, the paper P is separated from the conveyor belt 8, conveyed to a fixing roller 26, wherein the toner images are heated and fixed to a complete color image and discharged onto the paper receiving tray 28 by a paper discharging roller 27.

After completing the operations of toner image transfer, cleaning of the cleaner 21 and discharging of the charge elimination lamp 22, the image forming mechanisms 11*a*–11*d* will become ready to the next image forming by repeating the image forming operation described above until reaching required number copies. When the required number copies is reached, the image forming operation is stopped, the paper supply clutch 209 of the first paper supply mechanism 80 is turned OFF, and the image forming mechanisms 11*a*–11*d* wait the next image forming operation.

When performing the color image forming on an A3 size paper supplied from the manual paper supply tray 70, after placing A3 size coating paper P in the required number of sheets in the manual tray 70, start the copying. The manual paper supply mechanism 84 is turned ON by the paper supply clutch 209, the driving force of the main motor is transmitted to the first and second shafts 71*a*, 71*b* by the control of the paper supply driver 208 and these shafts are rotated at a specified speed. While toner images in respective colors are being formed on respective photosensitive drums 12, a paper P placed at the top position in the manual tray 70 is easily taken out against the paper adhesion force by the frictional paper supply force of the first through the fourth manual paper supply rollers 77*a*–77*d* of which total width is about 40% of A3 size paper P and rotating in the arrow direction v. Then, the top paper P is easily separated from the second and subsequent paper P by the frictional separation force of the separation roller rotating in the arrow directions w and x and sent out in the direction of the aligning roller 24.

Thereafter, the paper P is once stopped at the position of the aligning roller 24 and after the leading edge is aligned and sent to the transferring position of the conveyor belt 8 synchronizing with the toner images on the photosensitive drums 12. Then, the yellow, magenta, cyan and block toner images are multi-transferred on the paper at the positions of the photosensitive drums 12 and a full color image is completed on a A3 size coating paper after the fixing process and discharged on the paper receiving tray 28. Further, after the toner image transfer, the operation of the cleaner 21 and the charge elimination lamp and the image forming mechanisms 11*a*–11*d* become the ready state for next image forming operation. When a required number of copies is reached by repeating the image forming operations described above, the image forming operation is stopped, the paper supply clutch 209 of the manual paper supply mechanism 84 is turned OFF and the next image forming operation is waited.

In the case of the B5 size color image forming by supplying a paper from the manual tray 70, after placing a required number of B5 size coating paper P in the manual tray 70, start the copying. The manual paper supply mechanism 84 is then turned ON by the paper supply clutch 209. At this time, the first shaft 71*a* only is rotated by the control of the paper supply driver 208 of the controller 200 as the paper size if below A4 size. When toner images in respective colors are being formed on the photosensitive drums 12 by the image forming mechanisms 11*a*–11*d*, a paper P at the top position is taken out easily against the paper adhesion force by the frictional paper supply force of the first and second manual rollers rotating in the arrow direction v as a total width of B5 size paper is about 20% of the A3 size paper width. Then, a paper P at the top position is easily separated from second and subsequent sheets by the frictional separation force of the separation roller 72 rotating in the arrow directions w and x and sent in the direction of the aligning roller 24. Further, the third and the fourth manual rollers 77*c*, 77*d* of the second shaft 71*b* are rotated after the running of a paper P.

Thereafter, the paper P is once stopped at the position of the aligning roller 24 and its leading edge is aligned, and then, sent to the transferring position of the conveyor belt 8 synchronizing with toner images formed on the photosensitive drums 12. Then, yellow, magenta, cyan and black toner images are multi-transferred on the paper P at the positions of respective photosensitive drums 12 and after the fixing process, a full color image is completed on a B5 size coating paper P. The paper P is then discharged on the paper-receiving tray 28. Further, after transferring toner images and the processing of the cleaner 21 and the charge elimination lamp, the image forming mechanisms 11*a*–11*d* become the state ready to next image forming. When the image forming processes described above are repeated and when a required number of copies is reached, the image forming operation is stopped, the paper supply clutch 209 of the manual paper supply mechanism 84 is turned OFF and the image forming mechanisms 11*a*–11*d* become ready for the next image forming operation.

Further, when using ordinary paper, paper is supplied from one of the second through the fourth paper cassettes 40–60 and from the manual tray 70 as necessary. However, in the manual tray 70, the first shaft 71*a* only is rotated and ordinary paper is supplied by the frictional paper supply force of the first and second manual rollers 77*a*, 77*b*.

According to this first embodiment, a total width of the first pickup rollers 31 or the manual pickup rollers 71 is about 40% of the maximum paper width supported by the first paper supply tray 34 or the manual tray 70, and the frictional paper supply force of the first pickup rollers 31 or the manual pickup rollers 71 is large. Therefore, even when A3 size coating paper is used, it is possible to certainly separate sheets against the separation resisting force of paper by the paper adhesion force and easily supply a paper P at the top position. Accordingly, it becomes possible to supply a large amount of paper at a high speed using the first paper supply cassette 30 or the manual tray 70 and improve productivity of the image forming apparatus 10 without restricting size or kinds of paper P.

Further, as the aligning roller 24 is provided close to the first separation roller 32 or the manual separation roller 72, the first pickup roller 31 or the manual pickup roller 71 can be arranged in the vicinity of paper P. Further, the contact of paper P with the first pickup roller 31 or he manual pickup roller 71 tends to become unbalance as the paper adhesion force is strong and even when the skew of paper P was caused, the skew is improved immediately and the clogging of paper can be prevented.

Further, the manual roller 77*a*–77*d* of the manual pickup roller 71 can be arranged by scattering to the first and second shafts 71*a*, 71*b* and therefore, the degree of freedom in designing arranging positions of the manual pickup rollers 77*a*–77*d* can be expanded. Further, when supplying coating paper sized larger than A4 size, the manual pickup roller 71 drives both of the first and second shafts 71*a*, 71*b* and when supplying ordinary paper or coating paper smaller than A4 size, having lower paper adhesion force and separation resisting force, drives the first shaft 71*a* only and saves energy.

Figure 8:
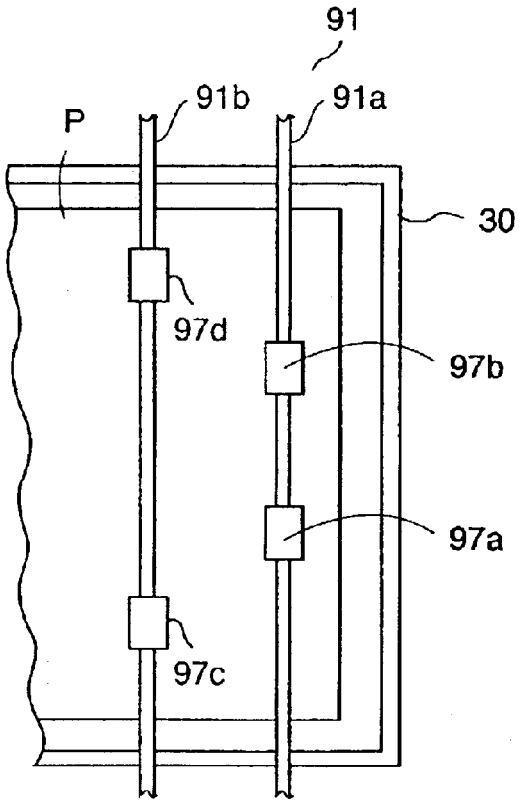
FIG. 8 is a schematic top view showing a pat of the first paper cassette and fifth pickup rollers in a second embodiment of the present invention.
Figure 9:
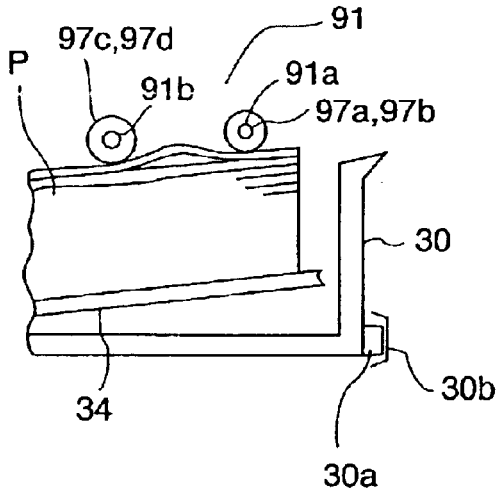
FIG. 9 is a schematic side view showing a part of the first paper cassette and the fifth pickup rollers in the second embodiment of the present invention.

Next, a second embodiment of the present invention will be described. This second embodiment differs from the first embodiment only in the first pickup roller. Therefore, in this second embodiment, the same elements as those explained in the first embodiment will be assigned with the same reference numerals and the detailed explanation thereof will be omitted. A fifth pickup roller 91 shown in FIG. 8 and FIG. 9 comprises first and the second rollers 97*a*, 97*b* in width 30 mm and diameter ϕ 20 attached to a first shaft 91*a* and third and fourth rollers 97*c*, 97*d* in width 30 mm and diameter ϕ 21 attached to a second shaft 91*b* and is controlled by a paper supply driver 208 of the control system for controlling the main body 10 of the apparatus.

A total roller width of the first and second rollers 97*a*, 97*b* is 60 mm which is about 20% of the maximum paper width 297 mm supported by the first paper supply tray 34, and a total roller width of the first through the fourth manual rollers 97*a*–97*d* is 120 mm which is about 40% of the minimum paper width 297 mm supported by the first paper supply tray 34. Further, the first and second rollers 97*a*, 97*b* attached to the first shaft 91*a* and the third and fourth rollers 97*c*, 97*d* attached to the second shaft 91*b* are so arranged that they are not overlapped when viewed from the paper P take out direction.

Further, the fifth pickup roller 91 is controlled by the paper supply driver 208 so as to drive the first shaft 91*a* only when the paper P on the first paper supply tray 34 is ordinary paper or coating paper smaller than A4 size and drive both the first and second shafts 91*a*, 91*b* in the case of coating paper larger than A4 size.

When executing the color image forming operation using A3 size coating paper, the first shaft 91*a* and the second shaft 91*b* of the fifth pickup roller 91 are rotated by the paper supply clutch 209. While respective color toner images are being formed on respective photosensitive drums in the image forming mechanisms 11*a*–11*d*, a paper P at the top position is easily taken out against the paper adhesion force by the frictional paper supply force of the first through fourth rollers 97*a*–97*d*. A total width of these rollers is about 40% of the width of A3 size paper. At this time, the diameters of the third and fourth rollers 97*c*, 97*d* are larger than the diameters of the first and second rollers 97*a*, 97*b*, and a paper P is bent between the first shaft 91*a* and the second shaft 91*b*, the paper adhesion force is reduced and a paper P can be taken out more easily.

Then, the paper P at the top position is easily separated from a second and subsequent paper by the frictional separation force of the separation roller 72 and sent out in the direction of the aligning roller 24. At the position of the aligning roller 24, the paper P is once stopped and after the leading edge is aligned, the paper P is sent to the transferring position of the conveyor belt 8 synchronizing with toner images on the photosensitive drums 12. Then, at the positions of the photosensitive drums 12 of the image forming mechanisms 11*a*–11*d*, yellow, magenta, cyan and black toner images are multi-transferred and a full color image is completed on an A3 size coating paper after the fixing process and the paper P is discharged on the paper receiving tray 28. After completing the prescribed image forming, the image forming operation is stopped, the paper supply clutch 209 of the fifth pickup roller 90 is turned OFF and the apparatus stands for the next image forming operation.

Further, when supplying coating paper smaller than A4 size using the first paper supply cassette 30, the first shaft 91*a* only of the fifth pickup roller 91 is rotated and a paper is supplied by the frictional paper supply force of the first and second rollers 97*a*, 97*b*.

According to this second embodiment, as a total roller width of the fifth pickup rollers 91 attached to the first shaft 91*a* and the second shaft 91*b* is about 40% of the maximum width of paper supported by the first paper supply tray and the frictional paper supply force of the fifth pickup roller 91 is large, it becomes possible to supply a top paper P easily and surely by separating even when a paper is A3 size coating paper against the paper separation resisting force by the paper adhesion force.

Furthermore, as the diameters of the third and fourth rollers 97*c*, 97*d* attached to the second shaft 91*b* of the fifth pickup roller 90 at the downstream side in the paper take-out direction are larger than those of the first and second rollers 97*a*, 97*b* attached to the first shaft 91 at the upper stream side in the paper take-out direction, the speed of the third and fourth rollers 97*c*, 97*d* at the downstream side becomes faster than the speed of the first and second rollers 97*a*, 97*b* when the first and second shafts 91*a*, 91*b* are rotated at an equal speed. As a result, the paper P is bent between the first shaft 91*a* and the second shaft 91*b*, a paper adhesion force between it and a second sheet is reduced, sheets can be separated certainly and the top paper P can be supplied more easily and certainly. Accordingly, it becomes possible to supply a large amount of paper at a high speed using the first paper supply cassette 30 and improve productivity of the image forming apparatus 10 without restricting size or kind of paper P.

Further, as the pickup rollers 97*a*–97*d* of the fifth pickup roller 91 can be arranged by dispersing them to the first and second shafts 91*a* and 91*b*, the degree of freedom in designing the arranging positions, etc. of the rollers 97*a*–97*d* can be expanded. Further, the fifth pickup roller 91 drives both the first and second shafts 91*a*, 91*b* when supplying coating paper larger than A4 size and drives only the first shaft 91*a* when supplying coating paper smaller than A4 size having a small paper separation resisting force and thus, the energy saved can be achieved. Furthermore, as the first through fourth rollers 97*a*–97*d* are arranged so that they are not overlapped when viewed from the paper P take-out direction, the rollers 97*a*–97*d* sliding contact a position of a paper P only one time and when compared with a case wherein the rollers sliding contact the same position of a paper P twice, generation of paper powder can be reduced.

Figure 10:
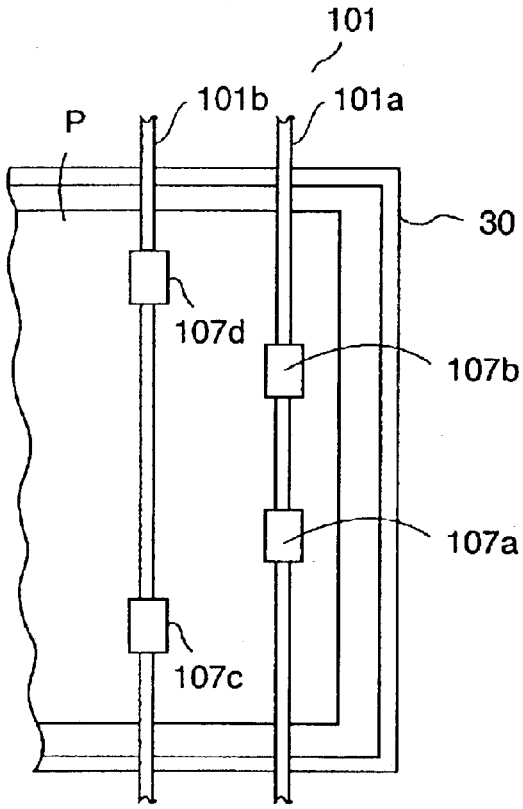
FIG. 10 is a schematic top view showing a part of a first paper cassette and sixth pickup rollers in a third embodiment of the present invention.
Figure 11:
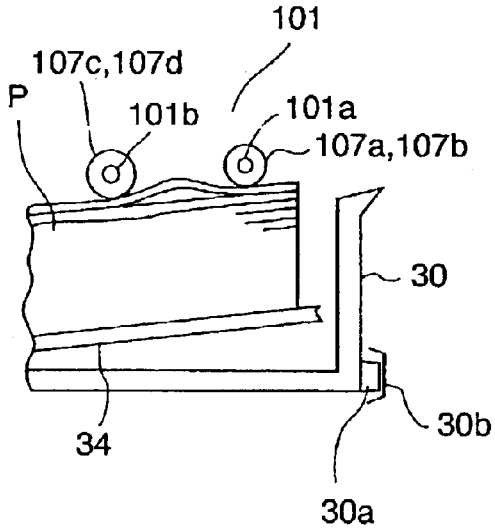
FIG. 11 is a schematic side view showing a part of the first paper cassette and the sixth pickup rollers in the third embodiment of the present invention.

Next, a third embodiment of the present invention will be described. This third embodiment has a fifth pickup roller differing from that in the second embodiment. Therefore, in this third embodiment the same component elements as those in the second embodiment will be assigned with the same reference numerals and the detailed explanation thereof will be omitted. A sixth pickup roller 101 shown in FIG. 10 and FIG. 11 comprises 30 mm wide first and second rollers 107*a*, 107*b* attached to a first shaft 101 and 30 mm wide third and fourth rollers 107*c*, 107*d* attached to a second shaft 101*b*, and these rollers are all in diameter ϕ 20 and controlled by the paper supply driver 208 of the control system that controls the main body 10 of the color copying machine.

However, the rotating speed controlled by the paper supply driver 208 of the sixth pickup roller 101 is so set that the rotating speeds of the third and fourth rollers 107*c*, 107*d* attached to the second shaft 101*b* become faster than the speeds of the first and second rollers 107*a*, 107*b* attached to the first shaft 110*a* by about 5%. All others are same as the second embodiment.

Accordingly, in the color image forming operation using A3 size coating paper, the second shaft 101*b* is turned faster by 5% than the rotating speed of the first shaft 101*a* of the sixth pickup roller 101 when color toner images are formed on respective photosensitive drums 12 in the image forming mechanisms 11*a*–11*d*. Thus, in the paper supply cassette 30, the top position paper is take out easily against the paper adhesion force by the frictional paper supply force of the first through fourth rollers 107*a*–107*d* of which total width is about 40% of A3 size paper P width. At this time, as the rotating speed of the third and fourth rollers 107*c*, 107*d* is faster than the rotating speed of the first and second rollers 107*a*, 107*b*, a paper P is bent between the first shaft 101*a* and the second shaft 101*b*, the paper adhesion force is reduced and it becomes more easy to take out a paper P.

Then, the top paper P is easily separated from a second and subsequent sheets by the frictional separation force of the separation roller 72 and is sent out in the direction of the aligning roller 24. The paper P is once stopped at the position of the aligning roller 24 and after aligned its leading edge, the paper P is sent to the transferring position of the conveyor belt 8 synchronizing with toner images on the photosensitive drums 12 and yellow, magenta, cyan and black toner images are multi-transferred on the paper at the respective positions of the photosensitive drums 12 in the image forming mechanisms 11*a*–11*d*, and after a full color image is formed on an A3 size coating paper P after the fixing process and the paper is discharged on the paper receiving tray 28. When the prescribed image forming is completed, the image forming operation is stopped, the paper supply clutch 209 of a sixth pickup roller 100 is turned OFF and the image forming mechanisms stand for the next image forming operation.

Further, when supplying coating paper smaller than A4 size using the first paper supply cassette 30, the first shaft 101*a* only of the sixth pickup roller 101 is rotated and paper is supplied by the frictional paper supply force of the first and second rollers 107*a*, 107*b*.

In this third embodiment, the paper supply may be so controlled that a paper P is bent between the firs shaft 101*a* and the second shaft 101*b* by adjusting the drive start timing of the first and second shafts 101*a* and 101*b* by the paper supply driver 208 of the control system that controls the main body 10 of the apparatus without controlling the rotating speeds of the first and second shafts 101*a* and 101*b* of the sixth pickup rollers 101, respectively.

That is, the rotating speeds of the first and second shafts 101*a* and 101*b* are controlled to a same speed. On the other hand, for example, when executing the color image forming operation using A3 size coating paper, first the downstream side second shaft 101*b* may be driven to rotate with the first shaft 101*a* stopped by the sixth pickup rollers 101 so as to bend a paper P between the first and second shafts 101*a* and 101*b* and then, a paper P may be supplied by rotating both the first and second shafts 101*a* and 101*b*.

According to this third embodiment, likewise the second embodiment, a total roller width of the six pickup rollers 101 is about 40% of the maximum paper width supported by the first paper supply tray 34 and the frictional paper supply force of the sixth pickup rollers 101 is larger. Therefore, even when A3 size coating paper is used, it is possible to supply a paper P at the top position easily and surely by separating sheets certainly against the separation resisting force of paper by the adhesion force.

Furthermore, when the paper supply speed or the paper supply start timing of the third and fourth rollers 107*c* and 107*d* attached to the second shaft 101*b* at the downstream side in the paper supply direction is made faster than that of the first and second rollers 107*a* and 107*b* attached to the first shaft 101*a* at the upper stream side in the paper supply direction, a top positioned paper P is bent between the first and second shafts 101*a* and 101*b* and the paper adhesion force between it and the second paper is reduced. Therefore, it becomes possible to separate sheets surely and supply the top paper P more easily and certainly. Accordingly, it becomes possible to supply a large amount of paper at a high speed using the first paper supply cassette without restricting size or kind of paper P and improve productivity of the image forming apparatus 10.

Further, likewise the second embodiment, as the rollers 107*a*–107*d* of the sixth pickup roller 101 can be dispersed and arranged to the first and second shafts 101*a* and 101*b*, the degree of freedom in designing arranging positions, etc. of the rollers 107*a*–107*d* can be expanded. When coating paper is small, the energy saving can be achieved by driving the first shaft 110*a* only.

Further, the present invention is not restricted to the above-mentioned embodiments but can be deformed variously within the scope of the present invention. For example, a total width of friction paper supply members is not limited if it is more than 40% of the maximum paper width and they are not restricted to paper supply rollers but can be of belt type. Further, when friction paper supply members are divided, the number of divisions and distributions of widths of divided friction paper supply members are not limited. However, when friction paper supply members are divided into at least more than 3 units and arranged symmetrically centering around the center line of the paper take-out direction, paper can be supplied uniformly in the axial direction of paper and generation of skew can be prevented. In addition, the construction, etc. of image forming apparatuses is entirely optional and a toner image in plural colors may be formed on a common photosensitive drum.

According to the present invention as described above in detail, a total width of friction paper supply members is made to more than about 40% of the maximum paper width so that manual frictional paper supply force is increased and therefore, paper on a paper tray can be separated and supplied easily and certainly. Accordingly, it becomes possible to supply a large amount of various kinds of paper at a high speed and a highly productive image forming apparatus is obtained without restricting size or kind of paper. Further, according to the present invention, the degree of freedom in designing when arranging friction paper supply members can be expanded by dividing and arranging friction paper supply members to plural shafts.

What is claimed is:

1. A paper feeder comprising:

a paper tray to support paper; and pickup rollers to take out a top positioned paper supported by the paper tray in a prescribed take-out direction, some of the pickup rollers being attached to a first shaft arranged at a leading edge side of the paper in the paper take-out direction and others of the pickup rollers attached to a second shaft arranged at a trailing edge side of the paper in the paper take-out direction, wherein a paper take-out speed by the pickup rollers attached to the second shaft is faster than a paper take-out speed by the pickup rollers attached to the first shaft.

2. The paper feeder of claim 1, wherein the pickup rollers have a total width more than 40% of maximum paper width that is supportable by the paper tray to take out the top position paper supported by the paper support member in the prescribed take-out direction.

3. The paper feeder according to claim 1, wherein the pickup rollers are arranged symmetrically centering around a center line in the paper take-out direction.

4. The paper feeder according to claim 1, wherein the pickup rollers are attached to the first and second shafts, respectively, do not to overlap each other when viewed from the paper take-out direction.

5. The paper feeder according to claim 1, further comprising a control mechanism to independently control a drive of the pickup rollers attached to the first shaft and attached to the second shaft.

6. The paper feeder according to claim 5, wherein the control mechanism controls the drive of the pickup rollers attached to the second shaft at a first speed and the pickup rollers attached to the first shaft at a second speed that is slower than the first speed.

7. The paper feeder according to claim 5, wherein the control mechanism starts to drive the pickup rollers attached to the second shaft at a first timing and the pickup rollers attached to the first shaft at a second timing that is slower than the first timing.

8. The paper feeder according to claim 1, wherein a total width of the pickup rollers is more than 40% of the maximum paper width supportable by the paper tray.

9. The paper feeder according to claim 1, wherein the diameter of the pickup rollers attached to the second shaft is larger than the diameter of the pickup rollers attached to the first shaft.

10. The paper feeder according to claim 9, wherein a total width of the pickup rollers is more than 40% of the maximum paper width supportable by the paper tray.

11. An image forming apparatus comprising:

a main body;

a paper supply tray provided in the main body to support paper;

pickup rollers to take out paper supported by the paper supply tray in a prescribed direction, some of the pickup rollers being attached to a first shaft arranged at a leading edge side of the paper in the paper take-out direction and others of the pickup rollers being attached to a second shaft arranged at a trailing edge side of the paper in the paper take-out direction, wherein a paper take-out speed by the pickup rollers attached to the second shaft is faster than a paper take-out speed by the pickup rollers attached to the first shaft;

a paper separation mechanism to separate the paper taken out by the pickup rollers one by one; and image forming mechanisms provided in the main body to form images on the paper separated by the paper separation mechanism.

12. The image forming apparatus according to claim 11, wherein the pickup rollers are arranged symmetrically centering around a center line in the paper take-out direction.

13. The image forming apparatus according claim 11, further comprising a control mechanism to independently control a drive of the pickup rollers attached to the first shaft and attached to the second shaft.

14. The image forming apparatus according to claim 11, wherein a total width of the pickup rollers is more than 40% of the maximum paper width supportable by the paper tray.

15. The image forming apparatus according to claim 11, further comprising an aligning roller provided after the paper separation mechanism to align the leading edge of the paper separated by the paper separation mechanism.

* * * * *